US010486899B1

(12) United States Patent
Stravitz

(10) Patent No.: US 10,486,899 B1
(45) Date of Patent: Nov. 26, 2019

(54) WASTE DISPOSAL DEVICE WITH BAG-GRABBING MEMBRANE

(71) Applicant: Dooli Products, Inc., New York, NY (US)

(72) Inventor: David M Stravitz, New York, NY (US)

(73) Assignee: Dooli Products, LLC, New York, NY (US)

( * ) Notice: Subject to any disclaimer, the term of this patent is extended or adjusted under 35 U.S.C. 154(b) by 0 days.

(21) Appl. No.: 16/207,338

(22) Filed: Dec. 3, 2018

(51) Int. Cl.

| | |
|---|---|
| ***B65B 67/00*** | (2006.01) |
| ***B65F 1/00*** | (2006.01) |
| ***B65F 1/14*** | (2006.01) |
| ***B65F 1/06*** | (2006.01) |

(52) U.S. Cl.
CPC ..... *B65F 1/0013* (2013.01); *B65F 1/06* (2013.01); *B65F 1/1415* (2013.01)

(58) Field of Classification Search
CPC ..... B65F 1/0013; B65F 1/03; B65F 1/1415
USPC ..... 220/495.01, 495.06, 495.08, 908, 908.1, 220/908.3, 229, 254.1, 254.3; 248/95, 248/100
See application file for complete search history.

(56) References Cited

U.S. PATENT DOCUMENTS

| | | | |
|---|---|---|---|
| 1,978,314 | A | 10/1934 | Lancaster |
| 4,644,610 | A | 2/1987 | Fish |
| 5,205,530 | A | 4/1993 | Fish |
| 5,695,088 | A | 12/1997 | Kasbohm |
| 5,987,708 | A | 11/1999 | Newton |
| 6,612,099 | B2 | 9/2003 | Stravitz |
| 6,804,930 | B2 | 10/2004 | Stravitz |
| 6,851,251 | B2 | 2/2005 | Stravitz |
| 7,114,314 | B2 | 10/2006 | Stravitz |
| 7,146,785 | B2 | 12/2006 | Stravitz |
| 7,243,811 | B1 | 7/2007 | Ramsey |
| 7,316,100 | B2 | 1/2008 | Stravitz et al. |
| 7,434,377 | B2 | 10/2008 | Stravitz et al. |
| 7,494,022 | B2 | 2/2009 | Buchalter et al. |
| 7,503,152 | B2 | 3/2009 | Stravitz et al. |
| 7,503,159 | B2 | 3/2009 | Stravitz et al. |
| 7,617,659 | B2 | 11/2009 | Stravitz et al. |
| 7,694,838 | B2 | 4/2010 | Yang et al. |
| 7,708,188 | B2 | 5/2010 | Stravitz et al. |
| 7,712,285 | B2 | 5/2010 | Stravitz et al. |
| 7,641,835 | B2 | 11/2010 | Ramsey et al. |

(Continued)

OTHER PUBLICATIONS

Search report for International Application PCT/US2019/019385 dated Apr. 26, 2019.

(Continued)

*Primary Examiner* — Andrew T Kirsch
*Assistant Examiner* — Elizabeth J Volz
(74) *Attorney, Agent, or Firm* — Brian Roffe

(57) ABSTRACT

Waste container including at least one wall defining an interior space receivable of a bag and a bag handling assembly coupled to the wall(s). The bag handling assembly includes a bag support defining an opening and including a membrane having at least one slot. Each slot is defined by a pair of opposed walls, possibly parallel to one another, and a curved wall at each end of the slot connecting the opposed walls together. The opposed walls of each slot are spaced apart a distance to enable a bag, when inserted through the slot(s), to be pinched by the opposed walls.

20 Claims, 7 Drawing Sheets

(56) References Cited

U.S. PATENT DOCUMENTS

| | | | | |
|---|---|---|---|---|
| 7,963,414 | B1 | 6/2011 | Stravitz | |
| 8,061,546 | B2 | 11/2011 | Ramsey | |
| 8,127,519 | B2 | 3/2012 | Stravitz | |
| 8,215,089 | B2 | 7/2012 | Stravitz | |
| 8,235,237 | B1 | 8/2012 | Stravitz | |
| 8,266,871 | B1 | 9/2012 | Stravitz | |
| 8,393,489 | B1 | 3/2013 | Stravitz | |
| 8,844,751 | B2 * | 9/2014 | Sakaguchi | B65F 1/06 220/253 |
| 8,910,821 | B1 | 12/2014 | Stravitz | |
| 8,973,774 | B1 | 3/2015 | Stravitz | |
| 9,828,721 | B2 | 11/2017 | Silverman et al. | |
| 9,950,853 | B2 | 4/2018 | Irwin-Kieling et al. | |
| 10,053,283 | B1 | 8/2018 | Stravitz | |
| 10,081,481 | B2 | 9/2018 | Fernandez de Castro | |
| 10,099,855 | B1 | 10/2018 | Higgins, II | |
| 10,273,070 | B2 | 4/2019 | Perkins et al. | |
| 2003/0085227 | A1 | 5/2003 | Azzarello | |
| 2004/0067169 | A1 * | 4/2004 | Krause | B01L 3/022 422/513 |
| 2005/0056649 | A1 | 3/2005 | Simonson et al. | |
| 2007/0289772 | A1 * | 12/2007 | Kuroda | H01L 25/0657 174/260 |
| 2008/0000912 | A1 | 1/2008 | Lin | |
| 2008/0264948 | A1 | 10/2008 | Kovacevich et al. | |
| 2009/0046955 | A1 | 2/2009 | Schember et al. | |
| 2010/0005762 | A1 | 1/2010 | Stravitz | |
| 2010/0006712 | A1 * | 1/2010 | Stravitz | B65F 1/0006 248/99 |
| 2010/0140423 | A1 | 6/2010 | Davies et al. | |
| 2010/0176126 | A1 | 7/2010 | Shikano | |
| 2011/0100996 | A1 * | 5/2011 | Dunn | B32B 27/08 220/495.01 |
| 2011/0170807 | A1 | 7/2011 | Khubani | |
| 2012/0211494 | A1 | 8/2012 | Morand | |
| 2013/0075406 | A1 | 3/2013 | Sakaguchi et al. | |
| 2014/0042168 | A1 | 2/2014 | Dunn et al. | |
| 2016/0167872 | A1 | 6/2016 | Dunn et al. | |

OTHER PUBLICATIONS

Written opinion for International Application PCT/US2019/019385 dated Apr. 26, 2019.

* cited by examiner

WASTE DISPOSAL DEVICE WITH BAG-GRABBING MEMBRANE

FIELD OF THE INVENTION

The present invention relates generally to waste disposal devices having a membrane that controls access to a bag and more particularly to a membrane for such a waste disposal device that engages the bag to reduce odor leakage from the waste contents in the bag below the membrane.

BACKGROUND OF THE INVENTION

Small waste disposal devices are common in households with toddlers in diapers, households with pets, hospitals, doctors' offices, biohazard laboratories, assisted living facilities, nursing homes and other locations where waste is generated and must be disposed of in a sanitary manner. Further, if the waste emits odors, the waste disposal device should also contain odors emanating from the waste.

Numerous waste disposal devices exist including those disclosed in U.S. Pat. Nos. 6,612,099, 6,804,930, 6,851,251, 7,114,314, 7,146,785, 7,316,100, 7,434,377, 7,503,152, 7,503,159, 7,617,659, 7,708,188, 7,712,285, 7,963,414, 8,127,519, 8,215,089, 8,235,237 and 8,266,871, all of which are incorporated by reference herein. Additionally, innovative waste disposal devices are disclosed in U.S. patent application Ser. No. 12/172,715 filed Jul. 14, 2008 (US 20100005762), Ser. No. 13/172,976 filed Jun. 30, 2011, and Ser. No. 13/270,697 filed Oct. 11, 2011, all of which are also incorporated by reference herein.

Some of these waste disposal devices include a lid which is coupled to a rotation mechanism whereby upon closure of the lid, the rotation mechanism converts the closing movement of the lid into rotation of a twisting mechanism which engages with a length of tubing or a plastic bag in the waste disposal device to thereby cause formation of a twist in the tubing or bag. The twist is situated above the waste products in the tubing or bag so that emanation of odors from the waste products in the container is reduced.

As an example, U.S. Pat. No. 8,393,489 (Stravitz) describes a container defining a waste-receiving compartment having an opening, a lid connected to the container and having a first, closed position covering the opening of the container and a second, open position in which the opening is exposed, and a rotation mechanism arranged in the container to rotate the waste-containing member when present in the container. The rotation mechanism rotates the waste-containing member upon closure of the lid without manual handling of the lid. To this end, the rotation mechanism includes a rack gear coupled to the lid at an upper end region thereof and a gear assembly having a first gear in meshing engagement with the rack gear, and a second, drive gear in meshing engagement with the waste-containing member and which is rotationally coupled to the first gear. Downward movement of the rack causes rotation of the waste-containing member by means of the gear assembly. A foot pedal assembly causes both opening of the lid when depressed and closure of the lid when the pressing force is removed. The foot pedal assembly includes a foot pedal which extends outward from a lower region of the container, a horizontal actuating member connected to the foot pedal at a first end region, and a spring that is moved against its bias upon depression of the foot pedal and returns to its original state when the pressing force on the foot pedal is removed. The spring is coupled to the rack gear such that when the spring returns to its original state, the spring pulls the rack gear downward and thereby enables or causes closure of the lid and rotation of the waste-containing member.

Another important patent in this field is U.S. Pat. No. 10,053,283 (Stravitz) which describes a container including a bag handling assembly having a retainer coupled to a container wall, a bag support pivotally coupled to the retainer, and a closure component pivotally coupled to the bag support independent of the pivotal coupling of the bag support to the retainer. A first attachment structure pivotally attaches the bag support to the retainer, e.g., a hinge component on the retainer and a cooperating hinge component on the bag support on a first side of an opening defined by the retainer. A second attachment structure pivotally attaches the closure component to the bag support, e.g., an additional hinge component on the bag support and a cooperating hinge component on the closure component on a second side of the opening defined by the retainer. To fix the bag between the closure component and the bag support, the bag support includes an inner wall for supporting an open end of the bag, as well as an outer wall spaced from the inner wall, and a rim portion between the inner and outer walls, with a channel being defined above the rim portion between the inner and outer walls. The closure component defines a channel on an underside dimensioned relative to the inner wall such that when the closure component is pivoted against the bag support, the inner wall is received in the channel. To secure the closure component to the bag support, the closure component preferably includes a tab and the bag support preferably includes a flexible retainer that cooperates with the tab to enable temporary securing of the closure component to the bag support via engagement of the tab with the retainer. The bag support optionally includes a membrane having intersecting channels and intersecting slits at an angle from the channels, the channels being dimensioned to allow the bag to be received therein.

It is recognized that some of the previously issued U.S. patents to the inventor describe waste containers that utilize a bag and wherein, upon opening and or closing of a lid, a series of gears rotates a pliable membrane having fingers through which the bag extends to cause temporary twisting and or un-twisting of a temporary twist in the upper region of the bag above the waste. One purpose of the temporary twist is to substantially contain (hold down) offensive odor until such time as the bag is filled with odiferous waste and is ready for removal. One embodiment even provides a welded foldable handle to which the open end of the bag is attached to enable easy removal of a waste-containing bag. Yet another embodiment requires cutting the continuous tube of film and tying a knot for subsequent removal.

These variations are offered in current waste pails sold by Munchkin Inc. and some are based on causing rotation of the waste via a resilient rubberized injection molded TPE plastic membrane. This membrane is generally designed with slits that form fingers therebetween with the fingers sufficiently spaced apart to enable entraining of waste by the membrane. If the fingers of the membrane were to be too close to each other, grab functionality would be impaired. Munchkin pails are marketed as the Munchkin Arm & Hammer Diaper Pail, the Munchkin Step Pail and the Munchkin Pail.

An improvement to the waste containers with membranes that rely on grabbing of the waste when inserted through the membrane to enable rotation of the entrained waste to form a twist in the bag or tubing that prevents odor release from the waste was sought in order to, among other things, improve odor release prevention while simplifying the components. For example, elimination of the rotational componentry would simplify design and manufacture of the waste container.

OBJECTS AND SUMMARY OF THE INVENTION

It is an object of the present invention to provide a waste container that includes a membrane having a unique design, configuration and characteristic hardness (durometer) and which is able to produce substantially the same or a better odor barrier effect as prior art membranes in waste disposal devices without utilizing a rotation mechanism to form a temporary twist in a bag or tubing passing through the membrane.

In order to achieve this object or one or more other objects, a container in accordance with the invention includes at least one wall defining an interior space receivable of a bag, and a bag handling assembly coupled to the wall(s). The bag handling assembly includes a bag support defining an opening and including a membrane having one or more slots. Each slot is defined by a pair of opposed, parallel walls and a connecting wall at each end connecting the opposed walls together. The opposed walls of each slot are spaced apart preferably a common distance along a length of the slot between a central region of the membrane and the connecting wall to enable a bag, when inserted through each slot, to be pinched by the opposed walls. In some embodiments, the membrane includes reinforcement ribs on a surface that project beyond the surface, e.g., a lower surface, and extend from a central region of the membrane linearly toward a circumferential edge of the membrane. The reinforcement ribs are between the slots, for example, one reinforcement rib between each adjacent pair of slots.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE DRAWINGS

Figure 1:
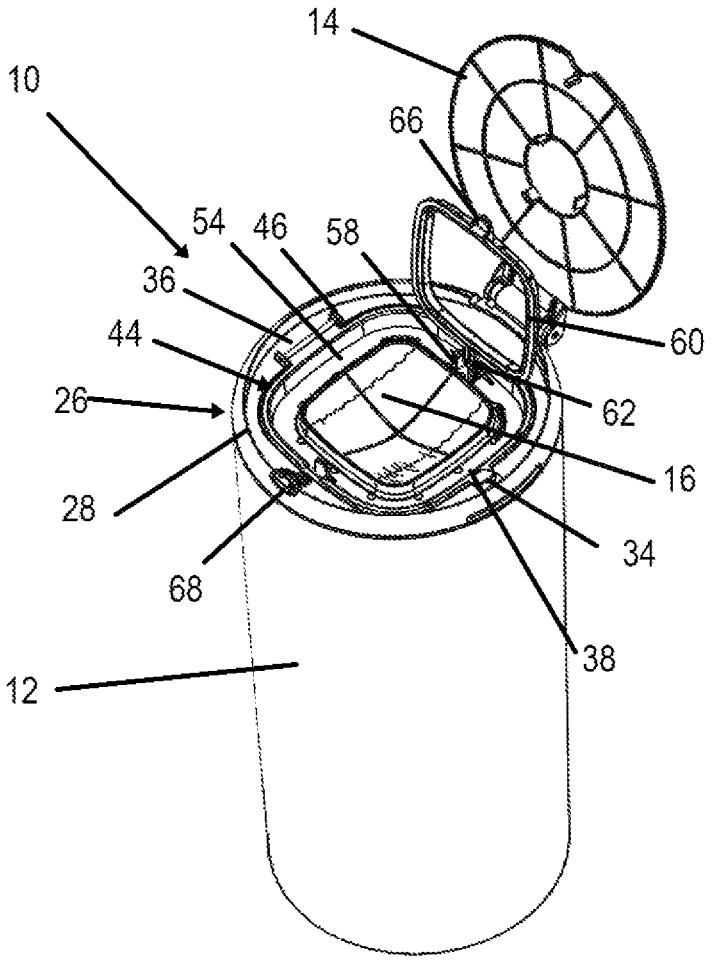
FIG. 1 is a perspective view of a waste disposal device in accordance with the invention shown in a state in which a lid is open and a bag is in place over a membrane, with a closure component raised above the bag.

Referring to the accompanying drawings wherein the same reference numbers refer to the same or similar elements, FIG. 1 is a perspective view of a waste disposal device or container 10 in accordance with the invention which is preferably used to dispose of waste, but which may be used for any purpose. Waste disposal device 10 includes an outer wall 12 that is substantially cylindrical, and a lid 14 that has a first, open position in which access to a bag 16 retained in the waste disposal device 10 is possible (as shown in FIG. 1) and a second, closed position in which access to the bag 16, and more generally, to the interior of the waste disposal device 10, is prevented. Outer wall 12 represents at least one wall that defines an interior space or compartment in the waste disposal device 10 that is receivable of a bag into which waste is to be placed. It may consist of a single wall or comprise multiple walls.

Waste disposal device 10 also includes a base (not shown) on which the outer wall 12 is supported, and a lid control mechanism that controls opening and closing of the lid 14, i.e., movement of the lid 14 between its open and closed positions. The base may alternatively be integrated into the outer wall 12. The control mechanism may include a foot pedal and actuating rods that cooperate to convert downward movement of the foot pedal into opening movement of the lid 14, see FIG. 5 of U.S. Ser. No. 10/053,283. The foot pedal may be biased to return to an upper position to enable repeated downward movement. One skilled in the art would understand how to make and use the control mechanism, and numerous and different types of control mechanisms are known to those skilled in the art and may be used in the invention. Often, the control mechanism is concealed in the outer wall 12 and/or the base of the waste disposal device 10. Another such mechanism is a simple push to open the lid by, for example, pressing the front top and in turn closing the lid 14 by pressing the lid 14 down. This is common and well known.

Indeed, the general properties of the waste disposal device 10 are not material to the invention and the invention may be used in any type, shape and size of container without limitation to the type and shape disclosed and illustrated herein.

Waste disposal device 10 includes a bag handling assembly 26 that has three main parts. Bag handling assembly 26 may have a unitary structure which is formed as a unit and then attached to the outer wall 12 of the waste disposal device 10. Bag handling assembly 26 may be an insert that is removable as a unit from the coupling to the outer wall 12.

The first part of the bag handling assembly 26 is a retainer 28 that extends inward from the outer wall 12 and when formed separate therefrom, may be coupled to the outer wall 12. Retainer 28 may be an integral part of the waste disposal device 10 or a separate component that may be temporarily or permanently attached to the outer wall 12 or another part of the waste disposal device 10 to provide a secure base for the remaining parts of the bag handling assembly 26. The retainer 28 may be attached to the outer wall 12 by structure disclosed in U.S. Ser. No. 10/053,283. The retainer 28 may also be molded together with the outer wall 12. Any structure which connects the retainer 28 to the outer wall 12 may be considered coupling means for coupling the retainer 28 to the outer wall 12. One skilled in the art of containers would understand that such coupling means encompass a wide variety of structure known to those skilled in the plastics manufacturing field.

Retainer 28 generally has the same shape as the cross-sectional shape of the outer wall 12 but this is not a limitation on the retainer 28. The term "coupled to" or variants thereof when used to describe a functional relationship between two components means that one component may be attached to the other component directly or may be attached indirectly to the other component via one or more other components.

Retainer 28 may have characteristics like the retainer in U.S. Ser. No. 10/053,283, for example, a substantially planar rim portion 32 and a hinge component 36 arranged on, coupled to or integrated into the rim portion 32. Rim portion 32 has a planar portion whose outer circumference is like the inner circumference of the region of the outer wall 12 to which it is coupled and an inner circumference like the outer circumference of the inward part of the bag handling assembly, i.e., a bag support 44.

The second part of the bag handling assembly 26 is thus the bag support 44 which includes a hinge component 46 that mates with hinge component 36 to enable the bag support 44 to pivot relative to the retainer 28. Bag support 44 has a generally annular form defining an opening, annular being used herein to mean defining an opening without limiting the shape of the bag support 44.

The structure of the hinge components 36, 46 may be any known type of structure which includes a part on each of two components with these parts interacting to allow for pivotal movement, whether a hinge or referred to by another commercial name. Such hinge components 36, 46 are well-known to those skilled in the field of hinges and more generally pivotal attachment structure. Exemplifying embodiment of the hinge components 36, 46 are disclosed in U.S. Ser. No. 10/053,283, which also describes additional features of the bag support 44. A hinge component 58 is arranged on or integrated into a lower wall 54 of the bag support 44.

The third part of the bag handling assembly 26 is a closure component 60 which includes a hinge component 62 that mates with hinge component 58 to enable the closure component 60 to pivot relative to the bag support 44. Hinge component 62 projects from an annular part of the closure component 60 by an extension piece, annular being used herein to mean defining an opening without limiting the shape of the closure component 60.

The structure of the hinge components 58, 62 may be any known type of structure which includes a part on each of two components with these parts interacting to allow for pivotal movement, whether a hinge or referred to by another name. Such hinge components 58, 62 are well-known to those skilled in the field of hinges and more generally pivotal attachment structure. Exemplifying embodiment of the hinge components 58, 62 are disclosed in U.S. Ser. No. 10/053,283.

The combination of the hinge components 58, 62 (second attachment means) are situated radially inward of the combination of the hinge components 36, 46 (first attachment means) because the closure component 60 is smaller in size than the bag support 44, and the bag support 44 is smaller in size than the retainer 28.

When the closure component 60 is in a down position against the bag support 44, the bag 16 is pressed between the closure component 60 and the bag support 44. More specifically, the closure component 60 defines a channel on an underside that is receivable of an inner wall of the bag support 44 such that upon pivoting of the closure component 60 into engagement with the inner wall, the bag 16 when present is clamped between the closure component 60 and the inner wall. This channel is generally defined by two spaced apart walls and bottom wall to form the downwardly oriented channel. Closure component 60 thus has a generally square shape like the shape of the inner wall, although their shapes may vary. The "general" square shape of the closure component 60 means that the closure component 60 has four sides but not necessarily that the edges of these sides that meet one another are exactly perpendicular to one another. The meeting edges may be curved as shown and the opposed sides of the closure component 60 are not required to be exactly linear and parallel to one another.

Bag support 44 therefore serves two important functions, first to provide a pivotal attachment to the retainer 28 to enable access to an interior of the waste disposal device 10 for removal of the bag 16 when it has been used to hold for example waste, and second to provide the inner wall to allow for selective clamping of an open end of the bag 16 by the closure component 60 against this inner wall. This clamping is a contact pressing with the bag 16 being pressed by the closure component 60 against the inner wall to thereby trap odor arising from material in the bag 16 inside of the bag 16. When the bag is not present, there may be contact between the closure component 60 and the inner wall or only a slight allowance of less than the thickness of a bag expected to be used in the waste disposal device 10.

The closure component 60 is not a required component and the bag handling assembly 26 may include only the retainer 28 and the bag support 44. In such an embodiment, the bag 16 is retained between bag support 44 and the retainer 28. Specifically, the bag support 44 is lifted up relative to the retainer 28 and the open edge of the bag 16 is placed alongside the retainer 28 and then the bag support 44 is pivoted downward to sandwich the open edge region of the bag 16 against the retainer 28 and thereby secure the bag 16 in the waste disposal device 10.

As to the former function, the bag support 44 can be pivoted upward by the cooperating hinge structure 36, 46 to enable access to the bag 16, and notably removal of a bag 16 containing waste while the bag support 44 is pivoted upward relative to the retainer 28. It is not required that the closure component 60 be pivoted upward away from the bag support 44 when the bag support 44 is pivoted upward relative to the retainer 28 to remove a bag from the waste disposal device 10.

Closure component 60 includes an optional tab 68 opposite the hinge component 62, and an optional flexible retainer 66 is arranged on the bag support 44, e.g., on the lower wall 54 of the bag support 44. The tab 68 can be pressed under a lip of the retainer to thereby secure the closure component 60 to the bag support 44 and prevent upward pivotal movement of the closure component 60 relative to the bag support 44. To release the tab 68 from the retainer 66, the retainer 66 is flexed outward allowing the tab 68 to be lifted upward. Additional details of the cooperation of a tab and retainer are disclosed in U.S. Ser. No. 10/053,283 and the inventor's earlier U.S. patent application Ser. No. 15/413,163 filed Jan. 23, 2017, Ser. No. 14/935,835 filed Nov. 9, 2015, Ser. No. 14/709,878 filed May 12, 2015, Ser. No. 14/537,044 filed Nov. 10, 2014, Ser. No. 14/109,270 filed Dec. 17, 2013, 61/881,386 filed Sep. 23, 2013, all of which are incorporated by reference herein.

Instead of the cooperating tab 68 and retainer 66, other structure may be provided on and/or integrated into the bag support 44 and the closure component 60 to enable the closure component 60 to be temporarily secured to the bag support 44 during use of the waste disposal device 10. Generally, such structure will be referred to as securing means for securing the closure component 60 to the bag support 44.

Bag support 44 includes a membrane 72 (as shown in FIGS. 2-5) that may be integrated into the bag support 44 by attaching it to the inner wall and/or the lower wall 54.

Membrane 72 may be a separate component from the bag support 44 and attached thereto. It may be injection overmolded, two-shot injection molded, or even press fit and possibly offered commercially with one or more membranes of different durometer or reinforcement to address the desired specific end use. For example, offensive odor or hazardous matter may be advantageously remediated by one such specified configuration (durometer and reinforcement structure-described below) while general household (kitchen waste) may be advantageously remediated by another resilient membrane with a softer durometer and fewer reinforced ribbing, etc. The ability to interchange membranes may offer a manufacturing advantage insofar as it provides a simplicity in keeping parts in stock and all remaining parts are common except for the specific membrane to perform a desired functionality directed to a given industry.

Figure 2:
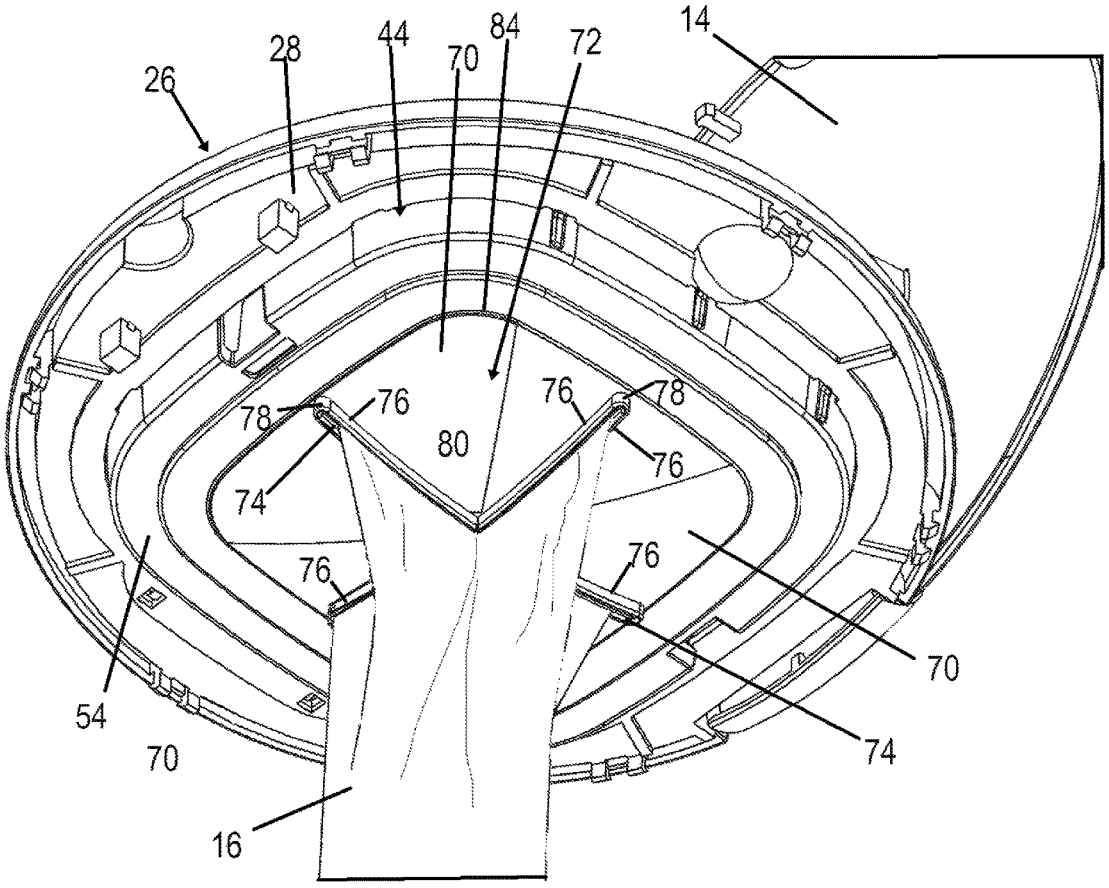
FIG. 2 is a perspective view of the underside of the retainer and membrane supported thereby while a bag passes through the membrane prior to and after waste insertion.

Membrane 72 includes four slots 74 arranged such that one pair of slots 74 aligns with one another and the other pair of slots 74 aligns with each other, with the aligning pairs of slots intersecting at an angle of about 90 degrees (see FIG. 2). Each slot 74 may be defined by a pair of substantially parallel walls (although they can also be interrupted so long as the bag is pinched). Yet continuous parallel walls creating a substantial narrow slit is a more positive means to retain (keep) offensive odors and germs in the portion of the bag 16 below the membrane 72. Close walls 76 will likely give the best odor barrier results. Walls 76 are spaced apart from one another and extend between a central region of the membrane 72 and a curved connecting wall 78 proximate a circumferential edge 84 of an elastic portion of the membrane 72. By the opposed walls 76 being substantially parallel, it is meant that the walls 76 do not have to be spaced apart the same distance along their entire length but that there may be a variation in the spacing between the opposed walls, including a progressive variation from one end of the slot 74 to the other end of the slot 74.

It is possible to vary the number of slots 74, more or less than the four as shown, and form each of these slots 74 from a respective pair of parallel walls 76 that extend from a point proximate an edge of the membrane 72 to or approximately to the center of the membrane 72. That is, a membrane in accordance with the invention may include only three slots 74, each extending from a point proximate a circumferential edge 84 of the membrane 72 to or approximately to the center of the membrane 72. Each slot 74 does not have to align with another slot 74, but rather, there may be equiangularly spaced on the membrane 72. Similarly, there may be any number of slots 74 equiangularly spaced on the membrane 72. When four or more slots 74 are formed on the membrane 72, one or more pairs of slots 74 may align with one another (alignment in pairs). Alignment of slots 74 means that the two slots 74 form a continuous channel through the center or central region of the membrane 72.

It is expected that providing fewer slots 74 offers added strength to the membrane 72 and provides a less complicated return of the membrane 72 to its previous unstressed state.

Figure 3:
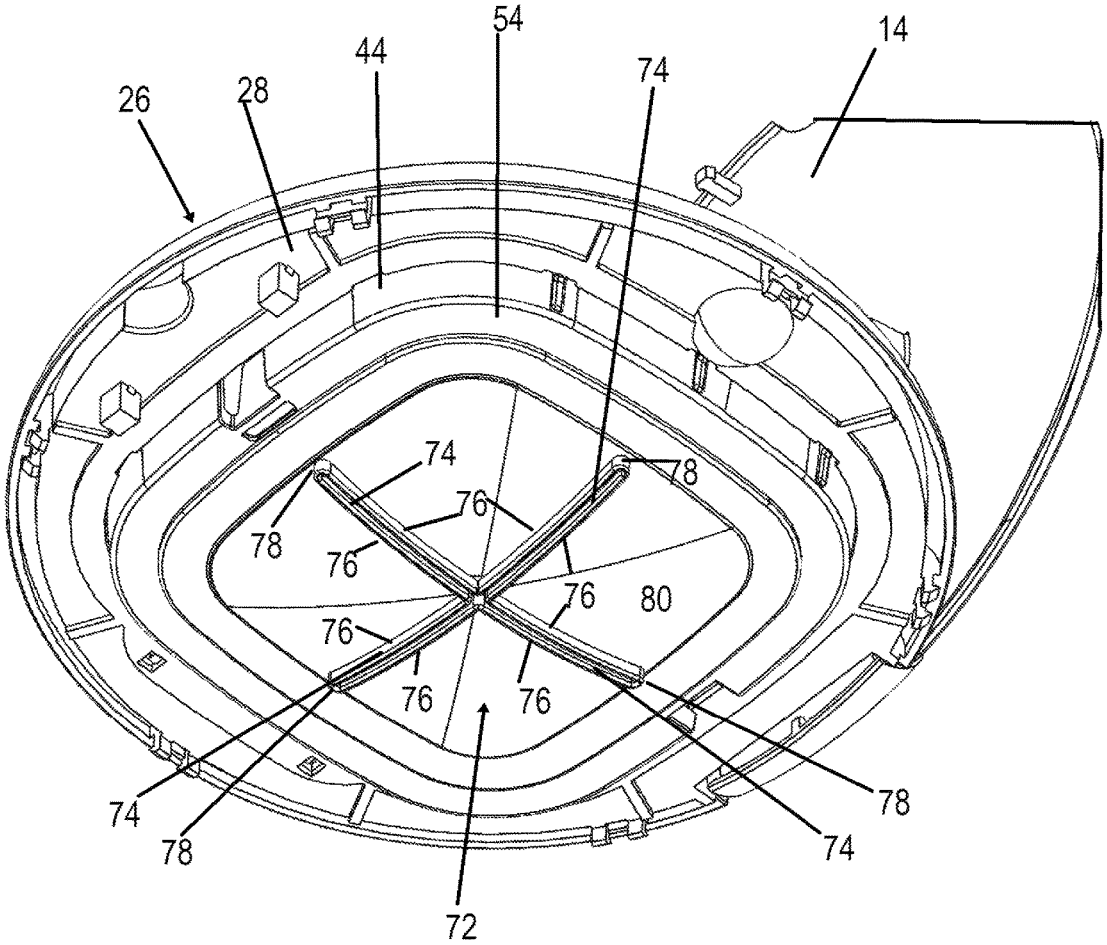
FIG. 3 is a perspective view of the underside of the retainer and membrane supported thereby without a bag.

With the disclosed formation of the membrane 72, it becomes possible to push the bag 16 through the membrane 72 such that a portion of the bag 16 is received in each slot 74 as shown in FIG. 3. The bag 16 is thus held by the membrane 72 while preventing release of odor from any waste in the bag 16. An added odor prevention feature is that the slots 74 can be configured to cause bunching of the bag 16 (discussed further below).

Figure 4:
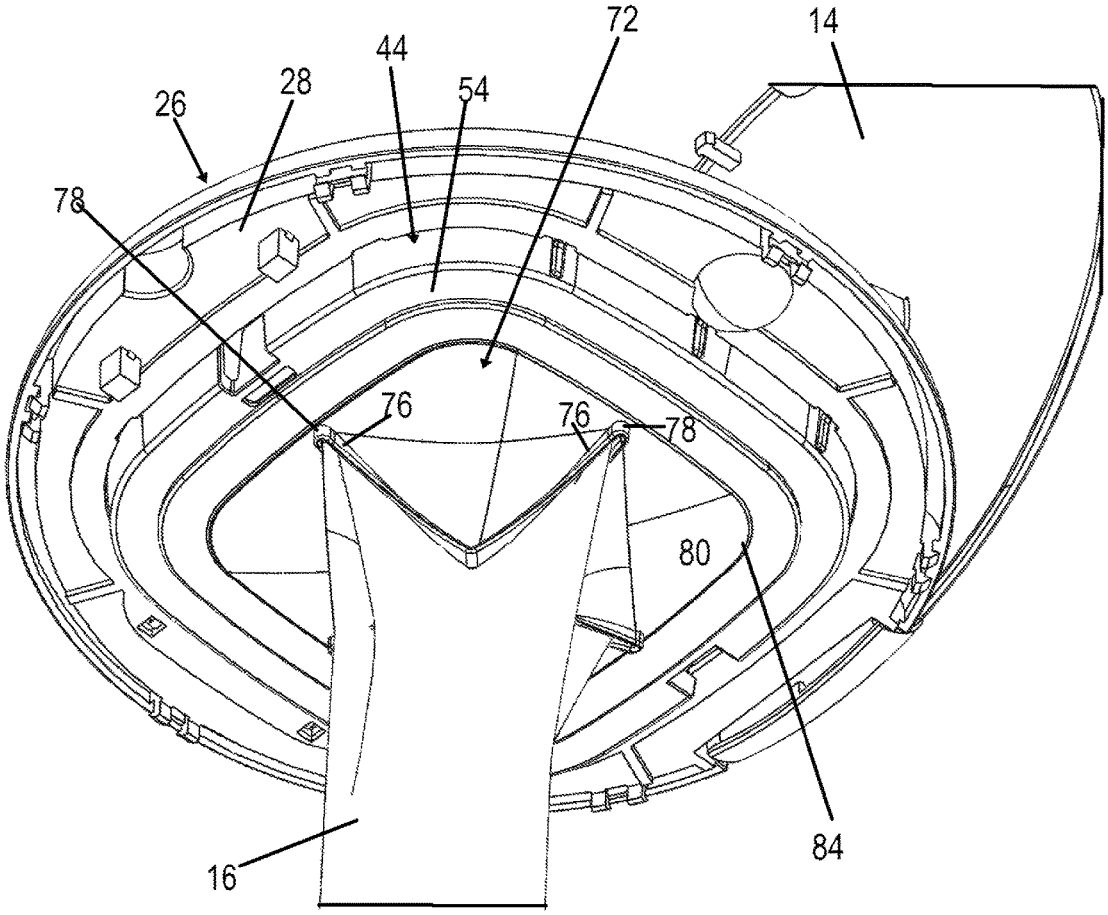
FIG. 4 is a perspective view of the underside of the retainer and membrane supported thereby while a bag passes through the membrane during waste insertion.
Figure 5:
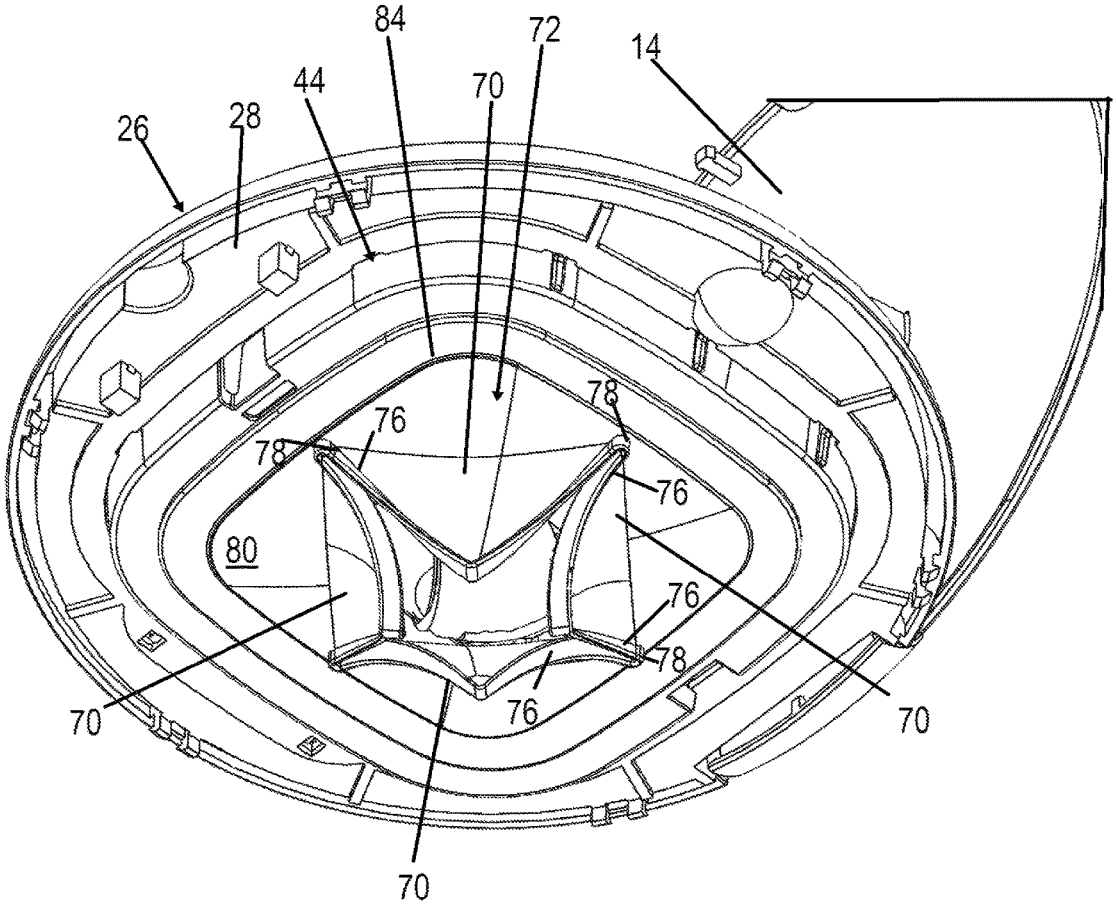
FIG. 5 is a perspective view of the underside of the retainer and membrane supported thereby during waste insertion showing the open state of the membrane.

FIG. 4 shows a situation where a waste item is being inserted into the waste disposal device 10 through the membrane 72. The waste item is pushed, either manually or by structure, against the membrane 72 to cause the fingers 70 of the membrane 72 to separate from one another and enable the waste to pass through the membrane 72. The open state of the fingers 70 of the membrane 72 is shown in FIG. 5.

As best seen in FIG. 3, the parallel walls 76 and curved wall 78 extend below the lower surface 80 of the membrane 72. The height of this extension may be dimensioned in accordance with the desired goals of the membrane 72 discussed below, notably, sealing the bag 16 when passing through the slots 74.

Figure 6:
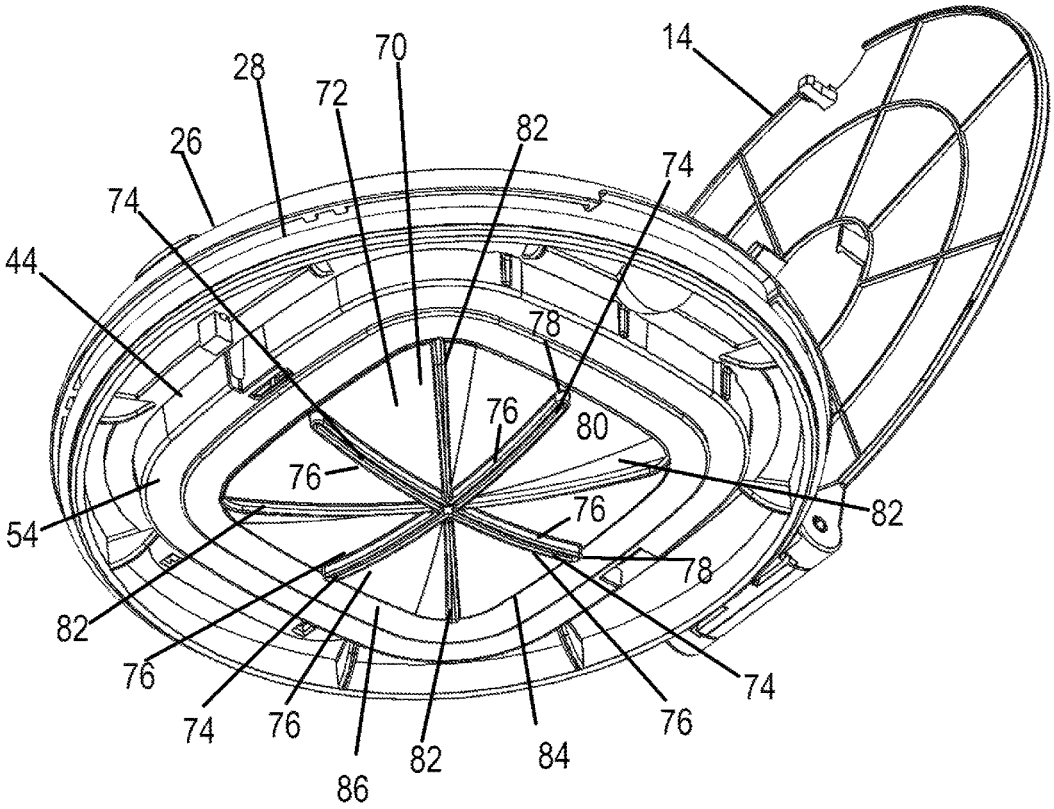
FIG. 6 is a perspective view of the underside of the retainer and membrane supported thereby of a second embodiment of the invention after waste insertion without a bag.
Figure 7:
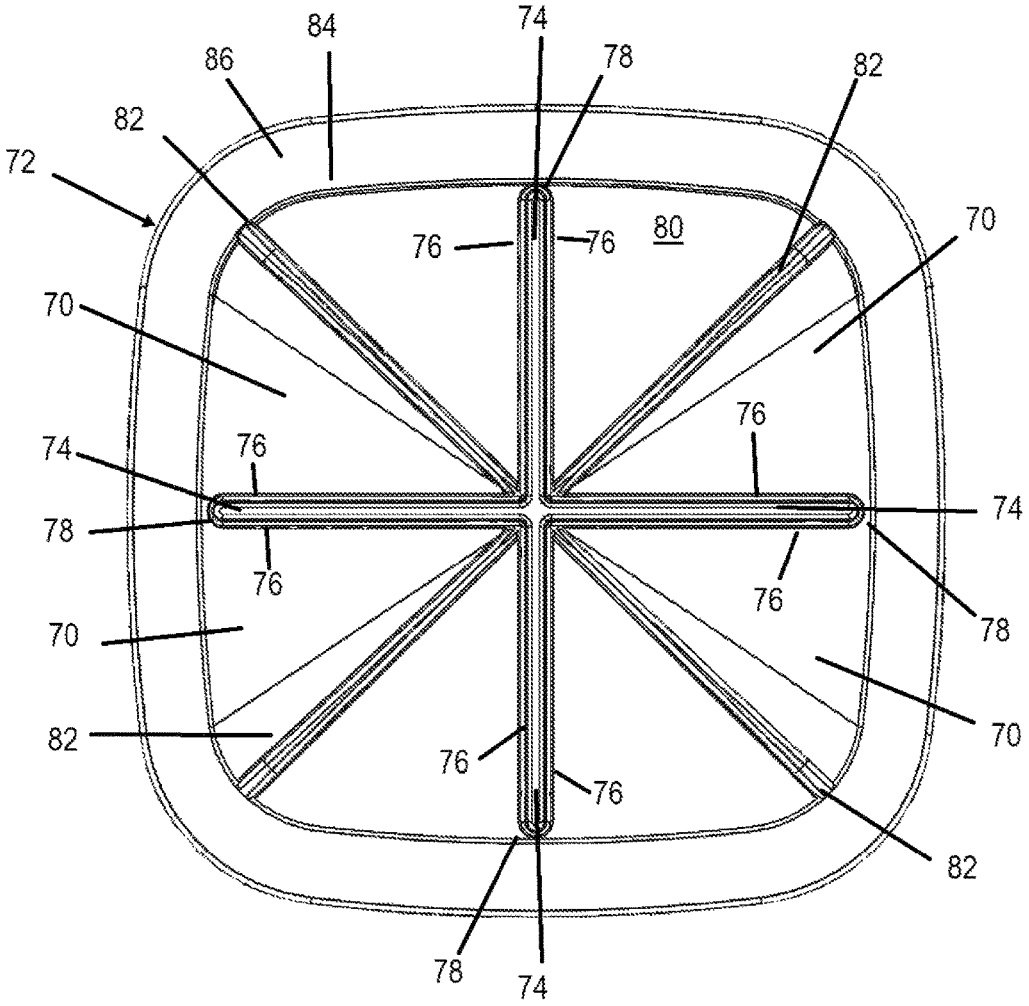
FIG. 7 is a bottom view of the underside of the membrane and its support portion of the embodiment of FIG. 6.

Referring now to FIGS. 6 and 7, the membrane 72 optionally includes supporting or reinforcement ribs 82 on its underside (extending downward from or above the lower surface 80) to aid in the return of the membrane 72 toward its original or previous state. Each rib 82 extends radially outward from a central region of the membrane 72 toward the circumferential edge 84. The inner edge of each rib 82 may be positioned at any location between two adjacent slots 74, although spaced apart equally from the adjacent slots 74 may be most desirable. Ribs 82 are preferably linear, i.e., straight from the central region toward a point proximate the circumferential edge 84 of the membrane 72.

Membrane 72 includes a first elastic portion in which the slots 74 are formed and on which the ribs 82 are formed, and a second portion 86 around and radially outward of the circumferential edge 84, as shown best in FIG. 7. This second portion 86 may be made of an inelastic material and provides support to the elastic portion. The membrane 72 is supported by the bag support 44 by providing a support rim or lip for the inelastic portion 86 on, for example, an inner circumferential surface of the bag support 44. The manner in which the membrane 72 is supported by the bag support 44 by its inelastic portion 86 is not material to the invention and any type of support structure is encompassed within the scope of the invention.

Each rib 82 may be formed by a raised portion of the membrane 72 that extends from about 2 mm to about 3 mm above the lower surface 80 of the membrane 72. In this connection, the term "above" means that if the membrane 72 were to be turned over and the lower surface 80 faced upward, the ribs 82 would be higher than the lower surface 80. However, when the membrane 72 is in place, the ribs 82 extend in the direction toward the bottom of the waste disposal device 10.

Each rib 82 preferably has a thickness between about 2 mm and 5 mm. As seen in FIG. 6, the height above the lower surface 80 of the membrane 72 can vary from a smallest height proximate the central region to a largest height proximate the circumferential edge 84. These dimensions can be changed so they are merely suggestions. Indeed, the above range is not meant to be limiting because, among other reasons, membranes 72 with different characteristics will enable formation of ribs 82 with a different range of thickness. As an alternative configuration of a reinforcement structure, instead of a single relatively thick rib 82, it is possible to provide two supporting ribs of thinner wall thickness parallel to each other. Accordingly, the length of the reinforcement structure (one or two ribs) and the thickness of each rib are variable and different numbers of ribs and different rib thicknesses could provide the same or similar results.

Although the membrane 72 is shown with four ribs 82 spaced approximately ninety degrees apart from one another, this configuration is not limiting. The membrane 72 may include any number of ribs 82, i.e., one or more, and there are not required to be situated equiangularly around the membrane 72.

Adding the reinforcement ribs 82 to the membrane 72 improves the resiliency of the membrane 72, increasing the inherent force in the membrane 72 that urges the membrane 72 to return to its previous state prior to waste insertion. As mentioned above, return of the membrane 72 toward and ideally to its previous, closed state, produces an effective barrier or odor containment shield.

Reinforcement ribs 82 may be helpful in the event the bag 16 below can be heavy when filled. The width of each rib 82 and the length of the rib 82 can be molded to form a substantial reinforcement to return the membrane 72 to its previous state after waste insertion. Each rib 82 can be at least as wide and at least as high as the typical thickness of the membrane 72 minimally, to as much as twice that. The length of each rib 82 may remain the same height or taper and run from the central area of the membrane 72 to the end (or short of the end) of the outer circumferential edge 84. Each rib 82 will significantly assist the membrane 72 to remain reasonably stable under excessive pressure. The selected membrane durometer, coupled with the rib 82 in combination will accomplish this.

The thickness of the membrane 72 should be ideally at least about 0.06 inches, i.e., 0.06 inches or more, depending on the durometer, and the width of the reinforcing ribs 82 should be reasonably the same height as the thickness of the membrane 72, and the length of each slot 74 may be approximately the entire distance from the center of the membrane 72 to the circumferential edge 84. The length of the slots 74 is a variable parameter that should be considered when designing the membrane 72 since shorter slots can bunch up the bag or tubing and such bunching contributes to better sealing of the opening of the bag (and thus improves the odor barrier).

Another variable parameter that can be adjusted is the width of the slots 74, i.e., the separation distance between the parallel walls 76. The substantial closeness of the parallel walls 76 to one another improves the reinforcement provided by the walls 76. One reason is that once waste is inserted through the bag 16, and in turn the slots 74, it is the close width of the slot 74 that has the most return effect. For example, if a slot 74 is about 0.03 inches wide and a bag or tubing is inserted through it, the slot 74 forces the bag or tubing to bunch up and form numerous creases. If the slot 74 is tight (for example, the walls 76 are from about 0.03 inches to about 0.06 apart) and a bunched, forced creased bag has a ragged width, this coupled with the friction of the membrane 72 causes the crimped bag to be temporarily captured in each of the slots 74 as the waste is urged through the membrane 72.

The closer the slots 74 are to one another, the more ragged folded creases form and air will cause effective engagement by the narrow slots 74. An increase in this bunching occurs, resulting in a more effective temporary odor barrier. The random creases, along with air being trapped loosely therebetween gives the bunched up creases of the bag 16 sufficient width to become substantially trapped in the close slots 74. In fact, the slots 74 do not necessarily need to be formed by exactly parallel walls 76, rather, so long as along the length of the slot 74 at least one or a plurality of opposing walls of the slots 74 are close to each other to effect a temporary pinch.

While it is ideally more effective for the walls 76 of each slot 74 to be parallel to one another, the membrane 72 provides for the crease forming and consequent odor barrier formation functionality even when they are not parallel to one another, for example, when the walls 74 are interrupted so long as one or more points of one wall 76 remains sufficiently close to the opposing wall 76 of the slot 74. It should even suffice if one point along the wall 76 is sufficiently close to an opposing point on the opposing side of the wall 76. They can even be offset from each other.

An important aspect is the formation of the slot walls 76 to pinch and hold the bag once it enters the slot 74 formed by the walls 76. Other constructions of the slot walls 76 to provide for this pinch and hold effect are readily ascertainable by those skilled in the art to which this invention pertains in view of the disclosure herein and considered by the inventor to be part of the invention. Subsequent insertions allow the slots 74 to allow waste to push the walls 76 open (FIG. 5) and afterwards the walls 76 return to memory (FIG. 3) and once again repeat the pinches provided by the walls 76. This will continue without interruption until such time as the bag 16 is removed. Throughout this repeated procedure, the narrow slots 74 effectively significantly restrict any updraft of offensive odor from the contents of the bag 16 below. The central area where all of the slots 74 end should be reasonably the same size as that of the slot thickness (i.e., the distance between the opposed walls 76) because this selected dimension will in itself cause a pinch in the central area of the bag 16, as well (see FIG. 7).

In one embodiment, the channels formed by aligning slots 74 are less than the width of the bag 16 when flat (by appropriately selecting a bag). This dimensioning forces the bunching condition to continue to fill the slots 74 with bunched, crimped bag portions that effectively assist in sealing and preventing offensive odor from escaping the waste below the membrane 72.

Another important point relates to the closeness of the central area where the slots 74 meet. The closer the internal regions of the slots 74 are to one another, the better the seal of the remaining crimped bag that is not trapped by the slots 74. In a preferred embodiment, the central opening should be in a range from about 0.03 inches to about 0.10 inches which will effectively grab the remaining central area of the bag to complete the effective temporary seal throughout the process.

To assist in keeping the membrane 72 functioning effectively and with minimum drag, it is desirable that the bag 16 used with the waste disposal device 10 be long enough so that it rests comfortably on the base of the waste disposal device 10 and remains so until such time as the bag 16 is full and ready for removal (exemplifying removal processes are described below). This minimizes drag and provides a seamless operation of odor containment. For example, a 21 inch high waste disposal device may use a longer bag such as one that is anywhere from about 32 inches to about 36 inches long. As the bag 16 fills up with waste, the bag 16 will remain full as still rest on the base of the waste disposal device 10 and the membrane 72 therefore will remain in its original state after each waste insertion. Reinforcing ribs 82 are advantageous especially when shorter bags are used if weight is an issue.

As used above, a membrane 72 is an example of a resilient component with narrow substantially reinforced slots 74 that when pressed (during waste insertion) causes the slots 74 to temporarily squeeze to thus have one side of the slot 74 engage the other side of the same slot 74. Furthermore, when a bag is placed on top of the membrane 72 and the waste, such as diapers, medical waste, left-over food, pet waste etc., is thus inserted to pass through the membrane 72 the following condition takes place: the width of the waste being inserted (diaper, a human hand inserting this waste, a crumpled milk carton, leftover take-out food etc) engages the bag 16 over the substantially parallel, close, substantially reinforced slots 74 which temporarily face each other and thus grab the bag (pinch it) leaving the bag substantially between each given slot 74 upon removing the hand.

Returning the membrane 72 to its previous, relaxed state is dependent on the weight of the waste below and the durometer of the membrane 72. Furthermore, the length of the slots 74, the reinforcement of the slots 74 and added reinforced ribs 82 will contribute to the membrane 72 returning to its previous state and thus produce effective barrier containment as well as that of the prior art waste disposal device including costly complicated rotational components.

In a preferred embodiment, the membrane 72 is curved (see FIG. 1), the substantially planar walls 76 are parallel and close to one another, the slots 74 are reinforced with ribbing that when depressed, one wall 76 of a slot 74 engages (touches) the other wall 76 of the same slot 74, the slots 74 are not all the way across so the curved non-slotted area assists in urging the membrane 72 back to its previous state after each insertion of waste. Reinforcement ribs 82 and the membrane curvature coupled with the distance between slot ends further assists the membrane 72 to return to effectively pinch the bag effectively in each narrow, substantially parallel-walled slot 74.

With heavier waste below, even if there is still a little sag in the membrane 72, the majority of the bag is still substantially pinching tight the bag between slots 74. This condition is minimized by one or more factors:

1) a change of durometer (for example from softer Shore 65 A to Shore 85 A);
2) adding one or more reinforcement ribs 82 to compensate for the added weight; and
3) providing a reinforced slot 74 with raised ribbing around the narrow slot 74 to assist the temporary caving of one side of the slot 74 meeting the other side to form the necessary permanent pinch (until the bag is removed).

The action occurs upon either placing the bag through the first waste insertion. Subsequent waste insertions will keep the bag substantially trapped in the parallel slots of the membrane 72 and thus form the desirable odor barrier as waste fills up the bag below the membrane 72.

FIGS. 4 and 5 show a more pronounced curvature of the membrane 72. The membrane 72 is curved from the curved wall 78 of one slot 74 to the curved all of each adjacent slot 74. This curvature contributes to the inherent property of the membrane 72 to return from its open state during waste insertion to its previous, closed state prior to waste insertion. This curvature is one factor to consider when designing the membrane 72 because the greater the curvature, the greater the force is that urges the return of the membrane 72.

In waste disposal device 10, bag removal is facilitated by, once the bag 16 is full or it is otherwise desired to change the bag 16, pivoting the closure component 60 upward relative to the bag support 44 to release the clamping force of the closure component 60 against the bag support 44 (to arrive at the state shown in FIG. 1). Then, the end of the bag 16 is grasped, tied or knotted, and then inserted through the membrane 72 into the interior of the waste disposal device 10. Then, the bag support 44 is pivoted upward relative to the retainer 28 by, for example, the user inserting their finger into a recess 38 in the retainer 28 and lifting the bag support 44 upward, e.g., a tab 34 of the bag support 44 (see FIG. 1), to thereby increase the size of the opening at the top of the waste disposal device 10. Finally, the bag 16 is grasped by the user's hand and pulled out of the interior of the waste container device 10.

As an alternative, the waste disposal device 10 may be provided with a door in the outer wall 12. In this case, a person seeking to remove the bag 16 simply opens the door in the outer wall 12, inserts their hand into the interior of the waste disposal device 10 and removes the tied or knotted bag 16 therefrom.

A new, single use bag is then procured, placed into the interior of the waste disposal device 10. This placement may be either before the bag support 44 is pivoted downward to rest on the retainer 28 or after. In the former situation, the bag support 44 is pivoted downward and the user has to extend their hand through the membrane 72 to reach the upper end of the bag 16 and pull the bag 16 through the bag support 44 to drape the upper end over the inner wall 50. In the latter situation, the user pushes the bag 16 through the membrane 72 and then drapes the upper end of the bag 16 over the inner wall. In both situations, the upper end of the bag 16 has its open end draped over the inner wall and then the closure component 60 is pivoted against the inner wall to secure this new bag 16 in a position ready for use.

Instead of the bag removal and insertion procedure described above involving the two pivotal movements to release the bag 16 from its clamping and then to increase the size of the opening, it is possible to construct the waste disposal device 10 with an access door in the outer wall 12, and then access the bag 16 with waste by opening the access door. An empty bag 16 may also be inserted through the access door and then its upper end passed upward through the membrane 72, then its upper end draped over the inner wall 50 and then the closure component 60 closed to clamp the upper end of the bag 16 between the inner wall 50 and the closure component 60.

An important feature of the embodiments of the waste disposal device disclosed herein is that they do not include costly complicated rotational components that serve to rotate the membrane while waste is entrained thereby. Lack of structure to enable rotation of the membrane enables considerably more simplified structure to retain the membrane and support the membrane on the container wall.

An important advantage of waste disposal devices with the membrane disclosed above is that it becomes possible to remove waste with minimal exposure to direct contact with odiferous and potential hazardous waste contents, there being sealed off below the membrane. The removal process entails tying a knot in a bag passing through the membrane. This bag, or more specifically the open edge of the bag, may be retained by structure on the membrane retainer or support structure such as disclosed in the patents and application mentioned above, or secured between the membrane retainer or support structure and a container wall. To enable tying of the knot, the open edge of the bag is first released from its retention, if necessary. It is possible that the bag is a drawstring bag which, instead of tying a knot, simply requires pulling on the drawing to close the bag and then tying the drawstring to itself, i.e., knotting the drawstring.

Regardless of the type of bag, the open edge of the bag is closed at a location above the membrane. The bag is then removed from the container without concern of odor from the bag releasing from the bag. For example, it is possible to insert the now-closed end of the bag through the membrane into the container, then lift the bag retaining structure upward to access the interior of the container and then lift out the waste-containing bag.

This provides a substantial improvement to prior waste disposal devices which involve direct exposure to the contents, for example, in those conventional waste pails utilizing inner liners, and to those diaper pails (e.g., sold by Munchkin and sold under the tradename Diaper Genie™) whereby the person removing the waste-containing bag has their face in front of the open bag each time then need to cut the tubing and tie the filled bag for subsequent removal. At this time, the tubing is further tied or knotted to begin a new bag. This exposure can, depending on the person's level of speed, last for a few minutes which unfortunately results in somewhat annoying exposure to, for example, odors from soiled fecal and urine-soaked baby diapers, as well as to possible contagions from the waste.

In the invention, by safely separating the waste below the membrane 72 from the beginning of the waste disposal process (since the bag placed into the container through the membrane 27 is initially sealed, and safely sealing it (tying a knot above the membrane 72) makes this a non-obvious distinct advantage.

This invention (notably, the bag handling assembly 26 with membrane 72) can be integrated into a waste disposal device in its entirety, or can be sold or offered as a retrofit to the myriad of existing waste disposal devices currently in use in homes, hospitals, nursing homes, bio-labs, offices and the like. This conversion can offer a level of safety where smell, bacteria and fungus pose a serious or annoying issue.

Durometer of the membrane 72 plays a critical component insofar as, depending on the contents and weight below the membrane 72, contributes to improving the function of the membrane 72 that provides an effective barrier. Appropriate selection of the durometer of the membrane 72 can be achieved by testing the same membrane 72 structure made from materials with different durometers, e.g., from Shore 65 A to Shore 85 A, and identifying which perform best. The best membrane durometer may be dependent on other factors, e.g., the size of the membrane 72, the number and size of the slots 74, the height of the walls 76, 78 below the lower surface 80 of the membrane 72, the length of the slots 74, the presence, number and construction of the reinforcement ribs 82, the expected weight of the waste, the expected thickness of the bag 16 to be used with the membrane 72, and other factors that would be obvious to those skilled in the art to which this invention pertains.

As used above, a membrane is an example of a resilient component that includes slots or slits to enable material passage therethrough. Other units or components that provide a similar functionality and may be referred to by a name other than a membrane are also considered to be encompassed by reciting a membrane in this specification.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention. Indeed, the membranes disclosed above may be used in any of the waste containers or waste disposal devices disclosed in the patents and application incorporated by reference herein, e.g., those identified above, to the extent the waste disposal devices include a membrane that can be replaced by the membranes disclosed herein.

The invention claimed is:

1. A container, comprising:

at least one wall defining an interior space receivable of a bag; and a bag handling assembly coupled to said at least one wall, said bag handling assembly comprising a bag support, and a retainer extending inward from said at least one wall at an upper end region of said at least one wall, said retainer defining an opening, said bag support being pivotally coupled to said retainer, said bag support defining an opening and including a membrane having at least one slot, each of said at least one slot being defined by a pair of opposed, parallel walls and a connecting wall at each end of said slot connecting said opposed walls together, said opposed walls of each of said at least one slot being spaced apart a common distance along a length of said slot between a central region of said membrane and said connecting wall to enable a bag, when inserted through said at least one slot, to be pinched by said opposed walls.

2. The container of claim 1, wherein said at least one slot comprises a plurality of slots.

3. The container of claim 1, wherein said at least one slot comprises at least one pair of aligning slots that form a channel extending through a center of said membrane or the central region of said membrane.

4. The container of claim 1, wherein each of said at least one slot extends from the central region of said membrane to a point proximate a circumferential edge of said membrane, said connecting wall of each of said at least one slot being proximate said circumferential edge of said membrane.

5. The container of claim 1, wherein said at least one slot comprises four slots spaced equiangularly around said membrane with each of said four slots aligning with another one of said four slots to thereby form two channels through said membrane.

6. The container of claim 1, wherein said membrane has a lower surface, and said opposed walls and said connecting wall extend below said lower surface to project beyond said lower surface.

7. The container of claim 1, wherein said at least one slot comprises a plurality of slots and a durometer of said membrane is selected to provide a return effect after fingers of said membrane defined between adjacent ones of said slots are pressed downward.

8. The container of claim 1, wherein said at least one slot comprises a plurality of slots and said membrane is curved downward such that there is a downward curvature between said connecting walls of adjacent one of said slots.

9. The container of claim 1, further comprising first attachment means for pivotally attaching said bag support to said retainer, said first attachment means comprising a hinge component on said retainer and a cooperating hinge component on said bag support on a first side of the opening defined by said retainer.

10. The container of claim 1, wherein said bag handling assembly further comprises a closure component pivotally coupled to said bag support independent of the pivotal coupling of said bag support to said retainer, said closure component defining an opening, said bag support and said closure component including cooperating clamping structure that clamps the bag when present between said bag support and said closure component while said closure component is pivoted against said bag support, whereby the bag is clamped by said cooperating clamping structure and, while said closure component is pivoted against said bag support and said bag support is pivoted against said retainer, passes through the openings defined by said bag support and said retainer and enables access to an interior of the bag through the openings defined by said closure component, said bag support and said retainer.

11. The container of claim 10, further comprising:

first attachment means for pivotally attaching said bag support to said retainer, said first attachment means comprising a hinge component on said retainer and a cooperating hinge component on said bag support on a first side of the opening defined by said retainer; and second attachment means for pivotally attaching said closure component to said bag support, said second attachment means comprising an additional hinge component on said bag support and a cooperating hinge component on said closure component on a second side of the opening defined by said retainer such that said first and second attachment means are on different sides of the opening defined by said retainer.

12. The container of claim 11, wherein said first attachment means are radially outward of said second attachment means such that said first and second attachment means are at different distances from a center of said bag handling assembly.

13. A container, comprising:

at least one wall defining an interior space receivable of a bag; and a bag handling assembly coupled to said at least one wall, said bag handling assembly comprising a bag support, said bag support defining an opening and including a membrane having a plurality of slots, each of said slots being defined by a pair of opposed walls and a connecting wall at each end of said slot connecting said opposed walls together, said opposed walls of each of said slots being spaced apart a distance to enable a bag, when inserted through said slot, to be pinched by said opposed walls, and wherein said membrane further comprises reinforcement ribs on a surface that project beyond said surface and extend from a central region of said membrane linearly toward a circumferential edge of said membrane, said reinforcement ribs being situated in an area of said membrane between and spaced apart from said opposed walls, each of said reinforcement ribs being situated between a respective adjacent pair of said slots.

14. The container of claim 13, wherein each of said reinforcement ribs extends from about 2 mm to about 3 mm beyond a lower surface of said membrane.

15. The container of claim 13, wherein each of said reinforcement ribs has a thickness from about 2 mm to about 5 mm.

16. The container of claim 13, wherein each of said reinforcement ribs has a variable height with the lowest height being closer to said central region and the largest height being closer to said circumferential edge of said membrane.

17. The container of claim 13, wherein said reinforcement ribs are spaced equiangularly around said membrane.

18. The container of claim 13, wherein each of said reinforcement ribs is spaced apart equally from the adjacent pair of said slots.

19. A container, comprising:

at least one wall defining an interior space receivable of a bag; and a bag handling assembly coupled to said at least one wall, said bag handling assembly comprising a bag support, said bag support defining an opening and including a membrane having a plurality of slots and a lower surface, each of said slots being defined by a pair of opposed, parallel walls and a connecting wall at each end of said slot connecting said opposed walls together, said opposed walls and said connecting wall extending below said lower surface of said membrane to project beyond said lower surface, said opposed walls of each of said slots being spaced apart a common distance along a length of said slot between a central region of said membrane and said connecting wall to enable a bag, when inserted through said slots, to be pinched along the length of said slot by said opposed walls wherever the bag contacts said opposed walls, and wherein said membrane further comprises reinforcement ribs on said lower surface that project beyond said lower surface and extend from a central region of said membrane linearly toward a circumferential edge of said membrane, said reinforcement ribs being situated in an area of said membrane between and spaced apart from said opposed walls.

20. The container of claim 19, wherein each of said reinforcement ribs is spaced apart equally from an adjacent pair of said slots.

* * * * *